US008418810B2

(12) United States Patent
Barr

(10) Patent No.: US 8,418,810 B2
(45) Date of Patent: Apr. 16, 2013

(54) COLLAPSIBLE MAN-LIFT FOR USE IN WIND TURBINE TOWERS

(75) Inventor: Hugh C. Barr, Brownwood, TX (US)

(73) Assignee: Barr Fabication LLC, Brownwood, TX (US)

( * ) Notice: Subject to any disclaimer, the term of this patent is extended or adjusted under 35 U.S.C. 154(b) by 195 days.

(21) Appl. No.: 12/892,386

(22) Filed: Sep. 28, 2010

(65) Prior Publication Data

US 2011/0073411 A1 Mar. 31, 2011

Related U.S. Application Data

(60) Provisional application No. 61/246,411, filed on Sep. 28, 2009.

(51) Int. Cl.
*E04G 3/30* (2006.01)

(52) U.S. Cl.
USPC ..... 182/150; 182/141; 182/142; 182/148; 182/222; 182/223

(58) Field of Classification Search ..... 105/149.1, 105/149.2, 238.1; 182/36, 141, 142, 148, 182/150, 222, 223; 297/217.7, 273, 277, 297/284.4, 337
See application file for complete search history.

(56) References Cited

U.S. PATENT DOCUMENTS

| | | | | | |
|---|---|---|---|---|---|
| 38,028 | A * | 3/1863 | Brown | 297/273 |
| 488,609 | A * | 12/1892 | Husbands | 297/277 |
| 1,868,187 | A * | 7/1932 | Avallone | 182/55 |
| 2,244,650 | A * | 6/1941 | Curran et al. | 297/487 |
| 2,433,859 | A * | 1/1948 | Wesley | 182/113 |
| 2,662,587 | A * | 12/1953 | McIlvaine | 297/411.32 |
| 2,761,396 | A * | 9/1956 | Harlan | 182/36 |
| 2,998,094 | A * | 8/1961 | Fisher | 182/142 |
| 3,095,060 | A * | 6/1963 | Reinhardt | 182/12 |
| 3,183,997 | A * | 5/1965 | Kleiss | 182/82 |
| 3,907,066 | A * | 9/1975 | Newton | 182/112 |
| 4,222,140 | A * | 9/1980 | Olewinski et al. | 14/71.3 |
| 4,347,913 | A * | 9/1982 | Cromer, Jr. | 182/142 |
| 4,570,749 | A * | 2/1986 | McKibbin | 182/36 |
| 4,650,036 | A * | 3/1987 | Matsuda | 187/239 |
| 5,009,284 | A * | 4/1991 | Authement, Sr. | 182/142 |
| 5,273,239 | A * | 12/1993 | De Parny et al. | 244/118.1 |
| 5,301,770 | A * | 4/1994 | Regan et al. | 182/128 |
| 5,671,823 | A * | 9/1997 | Oakes | 182/36 |
| 6,302,238 | B1 * | 10/2001 | Preusser et al. | 182/150 |
| 7,090,050 | B1 * | 8/2006 | Hedgepeth | 182/142 |
| 2008/0217104 | A1 * | 9/2008 | Bergeron | 182/142 |
| 2008/0271948 | A1 * | 11/2008 | Motes | 182/141 |
| 2009/0020361 | A1 * | 1/2009 | Teichert | 182/36 |

* cited by examiner

*Primary Examiner* — Alvin Chin Shue
*Assistant Examiner* — Colleen M Chavchavadze
(74) *Attorney, Agent, or Firm* — Strasburger & Price

(57) ABSTRACT

A collapsible man-lift for use in the hollow tower portion of a wind turbine includes a support frame assembly, a foldable floor assembly and a collapsible cage assembly. The support frame assembly includes a sub-assembly built in a triangular shape. The foldable floor assembly and the collapsible cage assembly are connected to the triangular sub-assembly portion of the support frame assembly.

11 Claims, 4 Drawing Sheets

COLLAPSIBLE MAN-LIFT FOR USE IN WIND TURBINE TOWERS

CROSS REFERENCE TO RELATED APPLICATION

This application claims the benefit of Provisional U.S. Patent Application No. 61/246,411 filed Sep. 28, 2009.

STATEMENT REGARDING FEDERALLY FUNDED RESEARCH AND DEVELOPMENT

The invention described in this patent application was not the subject of federally sponsored research or development.

FIELD

The present invention pertains to a device used in the servicing of equipment located within the hollow towers which are used to support wind turbines; more particularly, the present invention pertains to a device for moving a maintenance or repair technician within the hollow tower which positions the rotating blade set above the ground where wind energy will cause the set of rotating blades to turn.

BACKGROUND

The current emphasis among all countries to find cheaper and sustainable sources of renewable energy has had one of its most noticeable impact on the expanded use of wind turbines for the production of electricity. In the United States these wind turbines typically have a set of three large blades. The set of three large blades is attached to a device which converts rotational mechanical energy into electrical energy. The rotational mechanical energy is provided by the force of the wind against the set of three large blades. To maximize the conversion of wind energy to electrical energy, the structure used to support the set of rotating blades allows the entire set of rotating blades to turn with respect to the long, substantially vertical axis of the hollow tower to maximize the speed of blade rotation.

Positioning and supporting the set of large rotating blades and the associated equipment above the ground and in the path of prevailing winds is the large hollow tower. Within the large hollow tower are numerous pieces of equipment. This array of equipment is associated with the rotation of the blade set into the wind, the conversion of wind energy into electrical energy and the operational and performance monitoring equipment. The operational and performance monitoring equipment records information indicating both performance of the wind tower over time and any needs for maintenance or the replacement of key items. These key items located in the hollow tower must be maintained and, when necessary, replaced by maintenance and service technicians.

To facilitate the maintenance or replacement of equipment mounted within the hollow tower by maintenance and service technicians, multiple platforms or decks are positioned near where equipment is located. Formed within each platform deck within the hollow tower are openings. Specifically, in most hollow towers there is a hoist opening associated with each platform or deck for raising and lowering equipment to positions where the equipment within the tower may be serviced or replaced. Typically included within each deck is a ladder sized opening. The ladder sized opening enables the passage of a ladder therethrough. The ladder allows personnel within the tower to move to locations between the platforms or decks.

While a ladder may be sufficient for light maintenance work or the replacement of small pieces of equipment within the tower, there may be a need for something more substantial when large, heavy or unwieldy pieces of equipment must be maintained or replaced. Further, many equipment repairs performed by maintenance, service or repair technicians require the use of both hands. If a maintenance or service technician is on a ladder, then the use of both hands to work on equipment may be either impossible or dangerous. Further, OSHA safety requirements related to wind tower operation and maintenance may prohibit the completion of certain types of maintenance, service or repairs by technicians whose only support above a platform or deck is a ladder.

To meet the need for positioning a maintenance or service technician within a hollow wind turbine tower; particularly when it is necessary to service large, heavy or unwieldy pieces of equipment, some wind turbine operators have attempted to use cable hoisted man-lifts designed for use in a variety of above ground applications where the size of cable hoisted man-lift is not a pertinent consideration. These prior art man-lifts are typically attached to the top of the hollow tower and are moved vertically within the hollow tower by lifting cables. The lifting cables for prior art man-lifts may pass through openings in the platforms or decks within the hollow wind turbine tower.

Some of the prior art man-lifts are constructed in the form of a kit. The kit can be dismantled and then reassembled on each platform or deck within the hollow tower. When the maintenance, service or repair work has been completed by maintenance or service technicians in the space between the decks, the prior art man-lift kit is disassembled and moved, piece-by-piece up or down to the next platform or deck within the hollow tower. At the next platform or deck, the disassembled prior art man-lift kit is then re-assembled for movement between the next set of platforms or decks within the hollow tower.

Because the disassembly and re-assembly of prior art kit-type man-lifts takes time and risks injury to maintenance or service technicians from improper disassembly or re-assembly there is therefore a need in the art for a man-lift which can be easily passed through the openings in the platforms or decks without requiring the disassembly or re-assembly characteristic of prior art kit-type man-lifts.

SUMMARY

The disclosed invention is a collapsible man-lift. The collapsibility of the disclosed man-lift enables its use within the hollow tower portion of a wind turbine. By use of the disclosed collapsible man-lift, the need for disassembly and re-assembly of the man-lift when moving into the spaces between platforms or decks within the hollow tower portion of a wind tower is eliminated.

The disclosed collapsible man-lift includes a support frame assembly, a foldable floor assembly and a collapsible cage assembly.

The support frame assembly includes an angled support beam sub-assembly in its upper and central portions and a floor support sub-assembly in its lower portion.

The foldable floor assembly is sized to be positioned over and supported by the floor support sub-assembly of the support frame assembly.

The collapsible cage assembly is attached to the support frame assembly.

When the disclosed collapsible man-lift is in its collapsed state along its depth dimension, it will pass through the openings in the platforms or decks within the hollow tower portion of a wind turbine. Once having passed through an opening in a platform or deck within the hollow tower, the disclosed collapsed man-lift is expanded along its depth dimension into an un-collapsed or open configuration.

BRIEF DESCRIPTION OF THE DRAWING FIGURES

A still better understanding of the disclosed collapsible man-lift for use in wind turbine towers may be had from the drawing figures, wherein.

DESCRIPTION OF THE EMBODIMENTS

Figure 1:
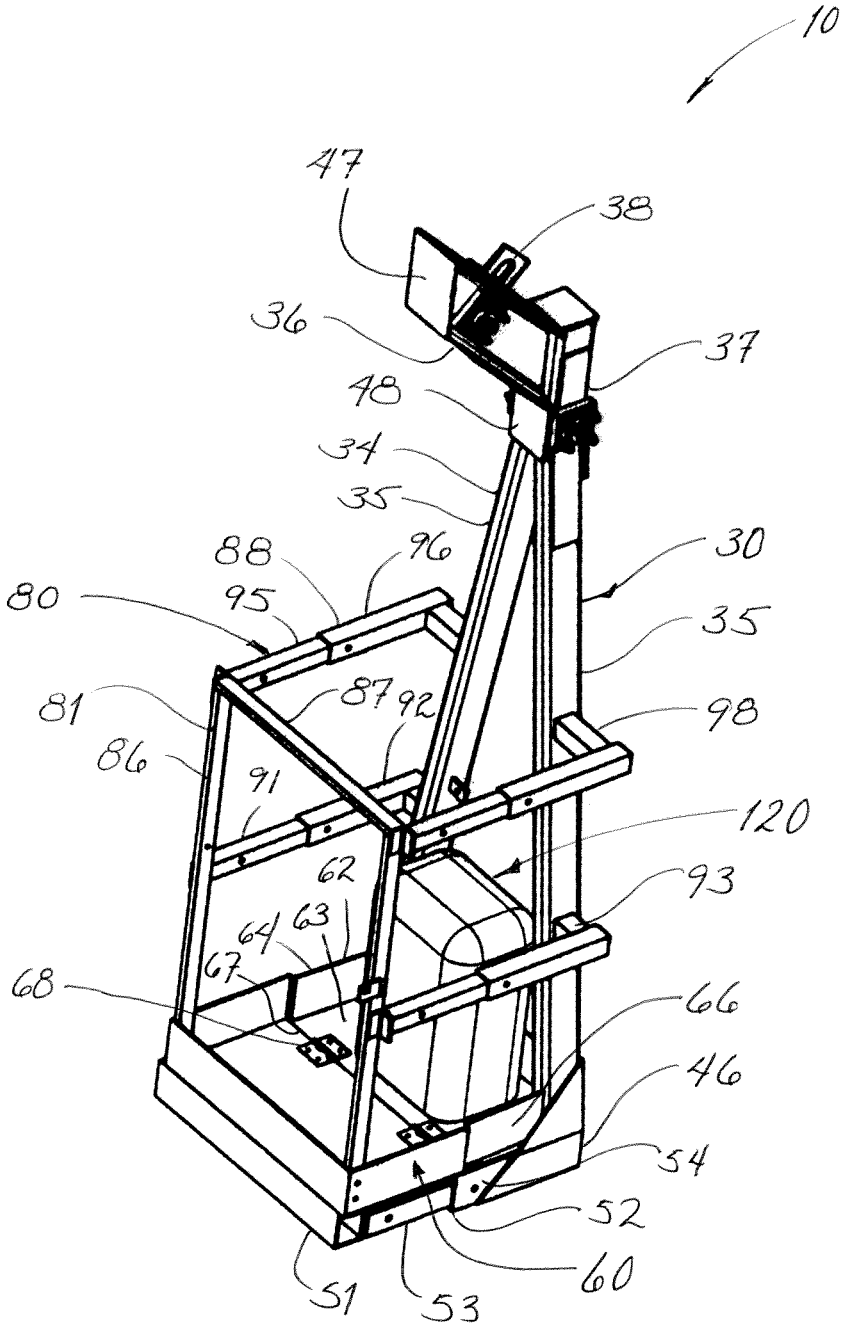
FIG. 1 is a right side front perspective view of the collapsible man-lift of the present invention.

As may be seen in FIG. 1, a right side perspective view of the collapsible man-lift 10 of the present invention, there are three assemblies within the disclosed invention. These three assemblies are the support frame assembly 30, the foldable floor assembly 60 and the collapsible cage assembly 80. These three assemblies of the disclosed collapsible man-lift 10 may also be seen in the left side perspective view shown in FIG. 2 where the motor assembly 120 has been removed for clarity. The motor assembly 120 is used where the disclosed collapsible man-lift 10 includes its own cable and hoist mechanism.

The support frame assembly 30 includes an angled upper support beam sub-assembly 32 and a floor support sub-assembly 46. It is from the angled upper support beam sub-assembly 32 that the collapsible man-lift 10 of the present invention hangs.

The angled upper support beam sub-assembly 32 includes a triangular frame 34 to which the other assemblies of the collapsible man-lift 10 are connected. The triangular frame 34 is formed substantially as an isosceles triangle. It is the angular position of the angled support beam 36 and the position of the cable attachment point 38 on the angled upper support beam 36 which allows the foldable floor assembly 60 on which the maintenance or service technician stands to remain substantially horizontal. At the bottom or open end of the triangular frame 34 is the collapsible floor support sub-assembly 46.

As may be seen in all of the drawing figures, the angled upper support beam sub-assembly 32 includes the angular support beam 36. The angular support beam 36 may be formed of square tubing, an I-beam or an I-beam including one or more plate reinforcements 37 as shown in the illustrated preferred embodiment. The number, size, and location of the plate reinforcements 37 will be well understood by those of ordinary skill in the art.

The angular support beam 36 connects with the top of the two triangular frame legs 35 which come together at a junction section 47. The junction section 47 is reinforced with one or more plates 48. Each of the triangle frame legs 35 is preferably formed of structural rectangular tubing. The bottoms of the triangular frame legs 35 connect with a support beam 99 to form the isosceles triangular frame 34. The support beam 99 connected to the triangular frame legs 35 is preferably a section of square structural tubing similar to the section of square structural tubing identified by reference number 51. As will be explained below, the remaining portions of the invention are connected to the triangular frame 34.

Figure 2:
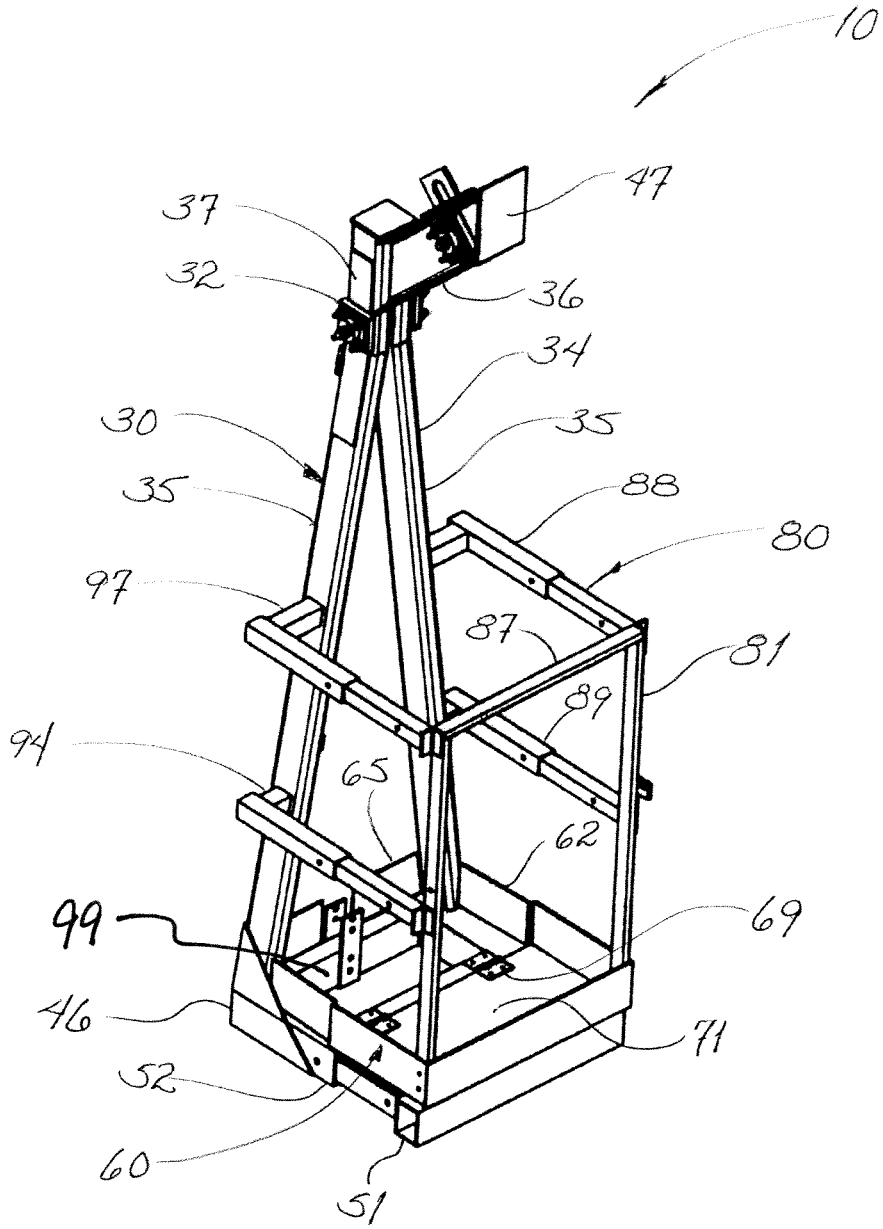
FIG. 2 is a left side front perspective view of the collapsible man-lift with the motor assembly removed.
Figure 3:
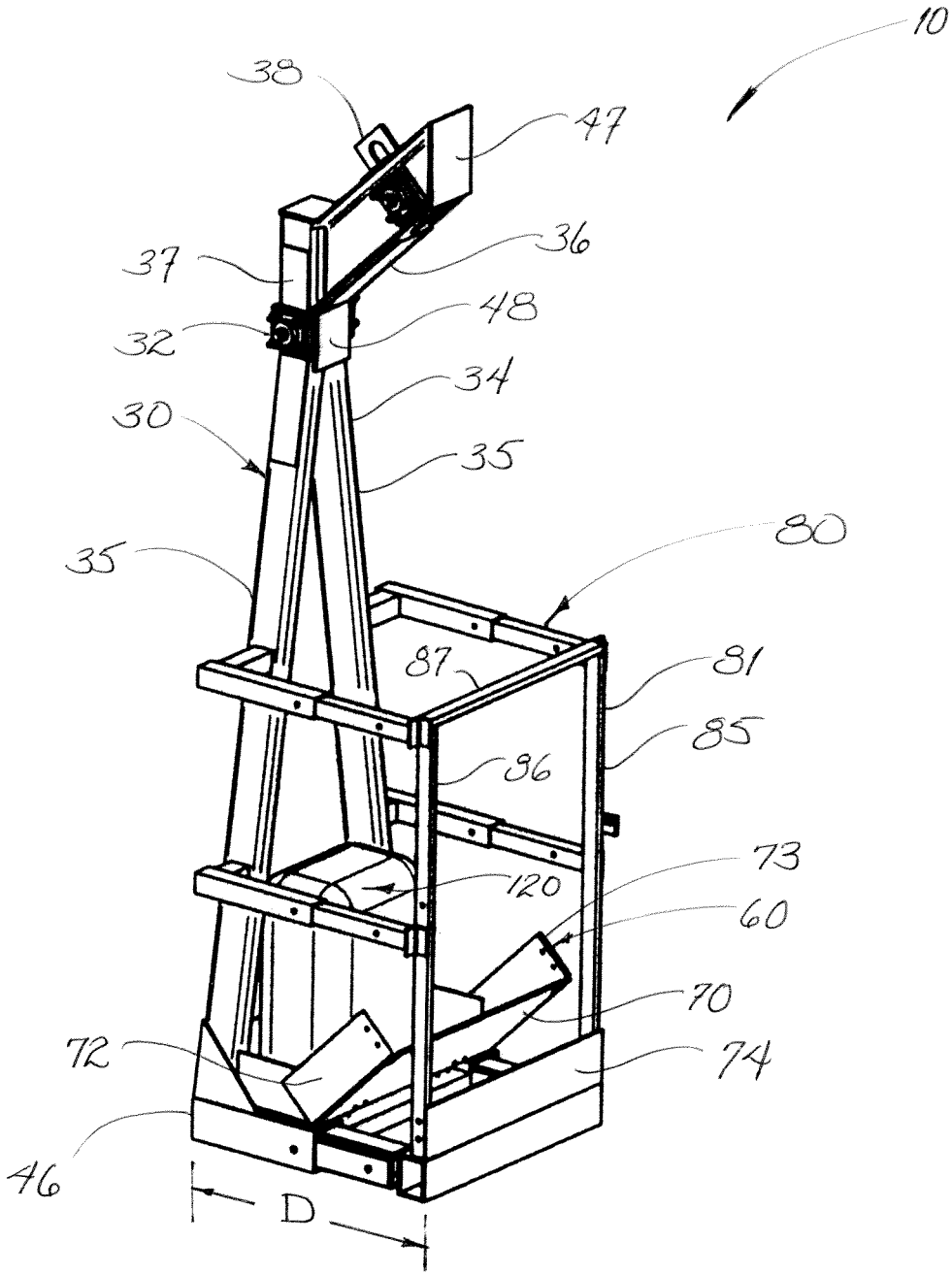
FIG. 3 is a view similar to FIG. 2 wherein the collapsible man-lift is in a partially collapsed condition.

The floor support sub-assembly 46 is a substantially rectangular set of structural members sized and arrayed to be collapsible in one dimension along a depth D as shown in FIG. 3. The substantially rectangular set of structural members is bordered by a front support beam 51 and the rear support beam described above as being connected to the bottom of the legs 35 of the triangular frame 34. Connecting the front support beam 51 and the rear support beam together are two collapsible side supports 52 having a telescopic construction as shown in FIG. 1 and FIG. 2. The two telescoping side supports 52 are positioned at either ends of the front support beam 51 and the rear support beam. The telescoping side supports 52 are shown in their extended configuration in FIGS. 1 and 2. FIG. 3 shows the telescoping side supports 52 partially collapsed and in FIG. 4, the telescoping side supports 52 are shown fully collapsed. In the preferred embodiment the telescoping side supports 52 are made from two sections of rectangular tubing. The front section 53 of the telescoping side supports 52 fits within the rear section of the telescoping side support 54.

The foldable floor assembly 60 is positioned over and supported by the collapsible floor support sub-assembly 46. The foldable floor assembly 60 includes a rear section 62 whose structure is similar to a three sided tray. The floor 63 of the three sided tray is preferably diamond plate typical of what is used for metal deck flooring. Extending upwardly from the sides of the diamond plate floor 63 are side pieces 64,66. The side pieces 64,66 extend to and are attached to the triangular frame legs 35 of the triangular frame 34. The third side 65 of the tray shaped rear section 62 extends between the triangular frame legs 35.

Figure 4:
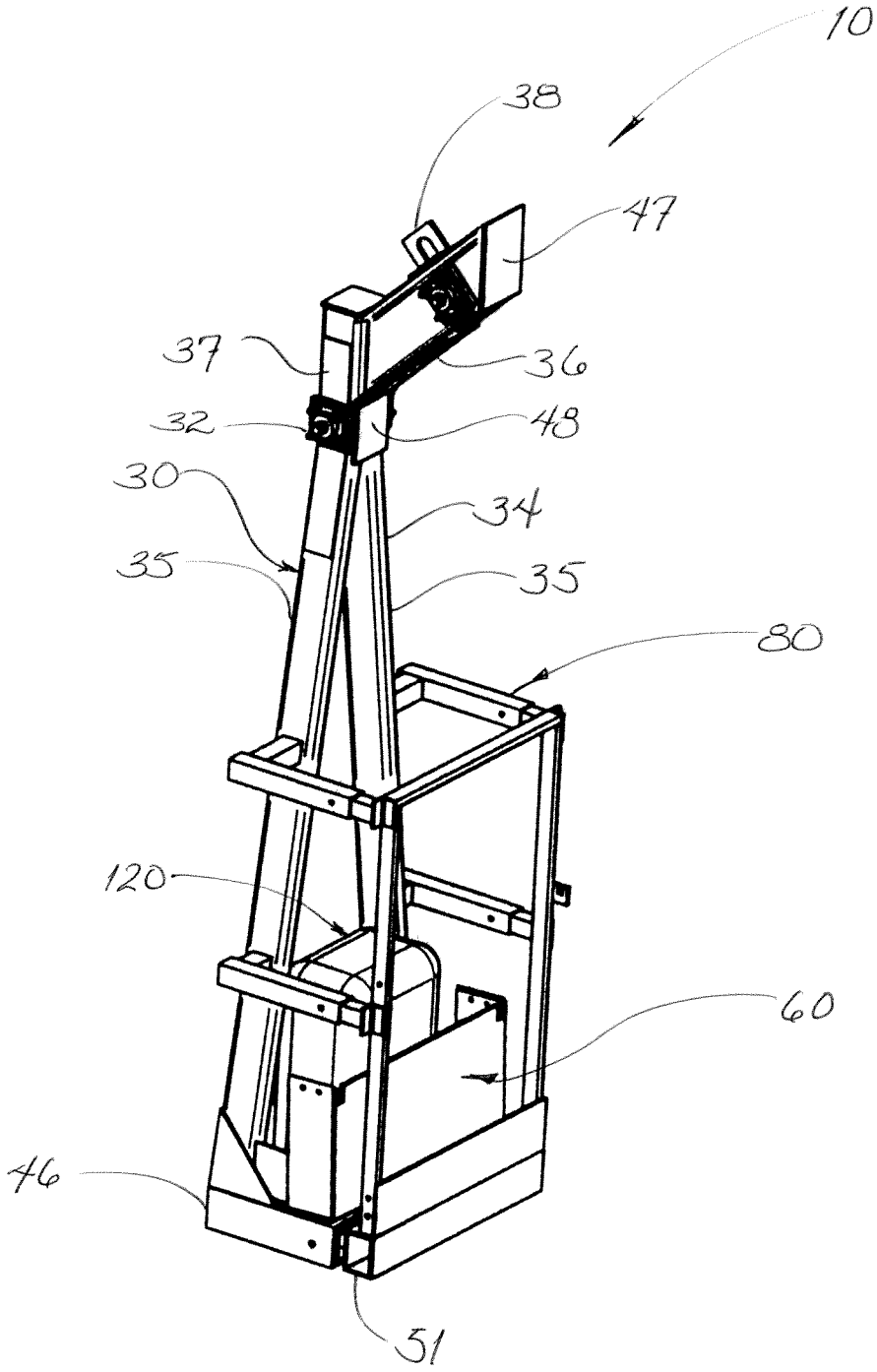
FIG. 4 is a view similar to FIG. 2 wherein the collapsible man-lift is in its fully collapsed condition.

Connected to the front edge 67 of the rear section 63 are two hinges 68, 69. Those of ordinary skill in the art will understand that more than two hinges may be used or alternatively a long piano hinge. It is the two hinges 68, 69 which connect the front section 70 of the foldable floor assembly 60 to the rear section 62 of the foldable floor assembly 60. This hinged connection enables the foldable floor assembly 60 to collapse or to fold in the middle thereby enabling the floor support sub-assembly 46 of the collapsible man-lift 10 to be reduced in its depth dimension D as shown in FIG. 4.

The front section 70 of the foldable floor assembly 60 is shaped similar to a two sided tray. Like the rear section 62 of the foldable floor assembly 60, a diamond plate serves as the floor 71. At either end of the diamond plate are affixed end pieces 72, 73. As may be seen in FIGS. 3 and 4, the end pieces 72 are spaced far enough apart to move outwardly of side pieces 64, 66 of the rear section 62. The analog in front section 70 to the third side piece 65 in the rear section 62 is plate 74 positioned over square structural tubing member 51.

As indicated above, the collapsible cage assembly 80 is connected to the triangular frame 34 which is positioned over the floor support sub-assembly 46. The collapsible cage assembly 30 extends along the depth D of the collapsible man-lift 10 from a substantially rectangular shaped structural section. The substantially rectangular shaped structural support section 81 include the plate 74 which is positioned over the front support beam 51 as discussed above. Attached to the plate 74, on either end, are substantially vertical risers 85, 86 which form the front of the collapsible cage assembly 80. Connecting the tops of the two substantially vertical risers 85, 86 is a substantially horizontal bar 87. The remaining portions of the collapsible cage assembly 80 extend substantially parallel to the depth dimension D of the collapsible man-lift 10 back to the triangular frame 34 from the structural substantially rectangular section 81 formed by plate 74, risers 85,86, and bar 87.

Substantially perpendicular to the two substantially vertical risers 85, 86 are an upper set 88 and a lower set 89 of two substantially horizontal telescoping side supports. The lower set 89 of two substantially horizontal telescoping side pieces 91, 92 extend toward the triangular frame 34. Connecting the lower set 89 of substantially horizontal telescoping side pieces to the triangular frame are short connection pieces. These short connection pieces 93, 94 connect the ends of the lower set 89 of two substantially horizontal telescoping side pieces 91, 92 to each of the two triangular frame legs 35. The upper set 88 of two substantially horizontal telescoping side pieces 95, 96 is similar to the lower set 89 of substantially horizontal telescoping pieces 91, 92 except they extend to a pair of longer connection pieces 97, 98 which connect the ends of the upper set 88 of two substantially horizontal telescoping side supports to a higher point on each of the two triangular frame members 35.

Operation of the disclosed collapsible man-lift 10 of the present invention is best understood by observing the sequence of drawing figures. In FIGS. 1 and 2 the disclosed collapsible man-lift 10 is in its extended or uncollapsed configuration. Placement of a lift cable at attachment point 38 on the angular beam 36 assures that the foldable floor assembly 60 remains horizontal. When it is desired to move the collapsible man-lift 10 through an opening in a platform or deck within the hollow portion of the wind turbine tower, the disclosed collapsible man-lift 10 is made ready to be put into its collapsed configuration as shown in FIG. 3. This is accomplished by removing any pins or locks which may be holding any of the telescoping collapsible portions in an extended position. Once the pins or lock have been removed the front portion 70 of the folding floor assembly 60 is lifted upwardly as shown in FIG. 3. This upward lifting of the front portion 70 of the folding floor assembly 60 provides room for the sets of telescoping side supports 88,89 of the collapsible cage assembly 80 and the collapsible side supports 52 of the floor support sub-assembly 46 to telescopically collapse inward along depth dimension D. Once the telescopic construction of side supports 88,89 of the collapsible cage assembly 80 and the collapsible supports 52 of the floor support sub-assembly 46 are locked in place with either pins or clamps to assure that they remain in a collapsed configuration along depth dimension D as the collapsible man-lift 10 is being moved. This inward collapse of the telescoping members along depth dimension D reduces the overall depth dimension of the collapsible man-lift 10 thereby enabling its movement through a hole or opening in a deck or platform with the hollow tower portion of a wind turbine.

Once the collapsible man-lift 10 has been moved, the process outlined above is reversed to restore the collapsible man-lift 10 to a configuration where it will safely support a worker. Specifically, the pins, clamps or locks holding the various telescoping pieces in position for movement are removed. Then, the collapsible man-lift 10 is expanded through the configuration shown in FIG. 3. When the telescoping pieces 88,89 and 52 are expanded to their full length, as shown in FIGS. 1 and 2, the various telescoping pieces 88, 89 and 52 are locked in position using pins, locks or clamps and the collapsible man-lift 10 is ready for use.

The height of the collapsible cage assembly 80 is selected so that a worker of average height has a hand hold on the horizontal bar 87 for safety purposes. Those of ordinary skill in the art will realize that the cross-bar 87 on the front of the collapsible cage assembly 80 may include hooks, brackets or pockets to contain a variety of commonly used tools or parts.

While a motor assembly 120, preferably for a cable and winch assembly is shown in the preferred embodiment, the collapsible man-lift 10 of the present invention may be supported and lifted by other cables or winch assemblies contained with the hollow tower portion of the wind turbine.

The disclosed collapsible man-lift has been made from structural aluminum pieces welded together; however other suitable material.

While the collapsible man-lift 10 has been described according to its preferred embodiment; still, other embodiments of the disclosed collapsible man-lift 10 will become apparent to those of ordinary skill in the art. Such other embodiments shall fall within the scope and meaning of the appended claims.

What is claimed is:

1. A collapsible man-lift for movement through the openings in the platforms or decks within the hollow tower portion of a wind turbine, said collapsible man-lift comprising: a support frame assembly including an angled support beam sub-assembly and a floor support sub-assembly; a foldable floor assembly positioned over and supported by said floor support sub-assembly of said support frame assembly; and a collapsible cage assembly attached to said support frame assembly; whereby, the collapsible man-lift may be reduced in size along a depth dimension to enable passage of the collapsible man-lift through the openings in the platforms or decks with a hollow tower portion of a wind turbine when the collapsible man-lift is in its collapsed position, wherein said angle support beam sub-assembly is formed substantially in the shape of an isosceles triangle formed from two frame legs of substantially equal length affixed to a support beam at their base and joined together in a junction section at their tops.

2. The collapsible man-lift as defined in claim 1 wherein said angled support beam sub-assembly further includes an angled support beam affixed to said junction section.

3. The collapsible man-lift as defined in claim 2 wherein said angled support beam includes a cable attachment point, said cable attachment point being located so that said foldable floor assembly will be substantially horizontal when the collapsible man-lift is suspended by a cable.

4. The collapsible man-lift as defined in claim 1 wherein said floor support subassembly is collapsible along said depth dimension by telescopic construction of side supports.

5. The collapsible man-lift as defined in claim 1 wherein said foldable floor assembly includes a front section and a rear section, said front section and said rear section being hingedly connected to another whereby said front section may be folded over said rear section.

6. The collapsible man-lift as defined in claim 5 wherein said front section of said foldable floor assembly is formed substantially as a two-sided tray including a floor and end pieces affixed to the edges of said floor.

7. The collapsible man-lift as defined in claim 5 wherein said rear section of said foldable floor assembly is formed substantially as a three sided tray including a floor, two end pieces, and a side piece affixed to the edges of said floor.

8. The collapsible man-lift as defined in claim 1 further including a substantially rectangular support frame positioned over said floor support assembly.

9. The collapsible man-lift as defined in claim 8 further including a plurality of telescoping side supports allowing for the collapsing of said cage assembly along a depth dimension.

10. The collapsible man-lift as defined in claim 9 wherein said telescoping side supports are connected to said rectangular support frame.

11. The collapsible man-lift as defined in claim 1 further including a hoist motor assembly positioned on the rear section of said foldable floor assembly.

* * * * *